US008315536B2

(12) United States Patent
Fujita

(10) Patent No.: US 8,315,536 B2
(45) Date of Patent: Nov. 20, 2012

(54) IMAGE FORMING APPARATUS HAVING COVER AND LOCK THAT REGULATES CLOSURE OF COVER

(75) Inventor: Keiko Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 12/825,113

(22) Filed: Jun. 28, 2010

(65) Prior Publication Data

US 2010/0329730 A1 Dec. 30, 2010

(30) Foreign Application Priority Data

Jun. 30, 2009 (JP) ..... 2009-155682

(51) Int. Cl.
*G03G 15/00* (2006.01)

(52) U.S. Cl. ..... 399/110; 399/13; 399/111; 399/124

(58) Field of Classification Search ..... 399/110, 399/124
See application file for complete search history.

(56) References Cited

U.S. PATENT DOCUMENTS

| | | | | |
|---|---|---|---|---|
| 4,209,211 | A * | 6/1980 | Alford | 312/215 |
| 5,398,098 | A * | 3/1995 | Fukunaga et al. | 399/110 |
| 2005/0047828 | A1* | 3/2005 | Kawai | 399/126 |
| 2006/0210307 | A1* | 9/2006 | Katoh et al. | 399/121 |
| 2007/0140710 | A1* | 6/2007 | Okano | 399/13 |
| 2007/0147884 | A1* | 6/2007 | Tanaka | 399/111 |
| 2007/0160384 | A1* | 7/2007 | Sakurai et al. | 399/110 |
| 2007/0196136 | A1* | 8/2007 | Yamamoto et al. | 399/258 |
| 2007/0223972 | A1* | 9/2007 | Isomura | 399/262 |
| 2008/0038004 | A1* | 2/2008 | Inoue | 399/45 |
| 2008/0124094 | A1* | 5/2008 | Eom | 399/9 |
| 2008/0124118 | A1* | 5/2008 | Ukai et al. | 399/110 |
| 2008/0131149 | A1* | 6/2008 | Onodera | 399/35 |
| 2008/0279583 | A1* | 11/2008 | Ishii et al. | 399/116 |
| 2009/0097879 | A1* | 4/2009 | Nagashima et al. | 399/120 |

FOREIGN PATENT DOCUMENTS

| | | |
|---|---|---|
| JP | 2003-248411 | 9/2003 |
| JP | 2007-052276 | 3/2007 |

* cited by examiner

*Primary Examiner* — David Gray
*Assistant Examiner* — Tyler Hardman
(74) *Attorney, Agent, or Firm* — Canon USA Inc IP Division

(57) ABSTRACT

An image forming apparatus includes a cover configured to open/close with respect to an apparatus main body of the image forming apparatus, a pullout unit, a locking member configured to lock the pullout unit according to an operation of inserting the pullout unit into the apparatus main body, and an abutting member movable between a position where the abutting member regulates the closure of the cover by abutting against the cover and a position where the abutting member does not regulate the closure of the cover. When the locking member does not lock the pullout unit, the abutting member is positioned at the position where the abutting member regulates the closure of the cover.

15 Claims, 7 Drawing Sheets

IMAGE FORMING APPARATUS HAVING COVER AND LOCK THAT REGULATES CLOSURE OF COVER

BACKGROUND OF THE INVENTION

1. Field of the Invention

The present invention relates to an image forming apparatus that forms an image on a paper sheet.

2. Description of the Related Art

Conventionally, as a pullout unit for integrally pulling out a transfer unit, a pre-fixing conveyance unit, a fixing unit, and a sheet conveyance unit such as a two-sided conveyance unit of an image forming apparatus, there is available a unit configured to pull out from an apparatus front side of an apparatus main body. The unit is used to perform, for example, handling of a paper sheet clogging (hereinafter, referred to as jam) in a sheet conveyance path provided in the pullout unit or maintenance of the apparatus, while the pullout unit is in a state of being pulled out from the apparatus main body.

The pullout unit is provided with an operation lever that can be rotated around a rotation central axis parallel to a pullout direction. By rotating the operation lever, locking and unlocking operations of the pullout unit can be performed with respect to the apparatus main body. If mounting of the pullout unit is incomplete, the pullout unit is configured so that the locking operation by the operation lever cannot be performed as discussed in Japanese Patent Application Laid-Open No. 2007-052276.

However, in conventional configuration in which locking and unlocking operations are performed by operating the operation lever, which is rotated around a rotation shaft parallel to the pullout direction, since locking operation is performed by rotating the operation lever after the pullout unit has been inserted, thus resulting in poor operability. It may be possible that locking operation is automatically performed by the inserting operation of the pullout unit, but in this case, it is not easy to confirm whether the pullout unit has been locked.

SUMMARY OF THE INVENTION

The present invention is directed to an image forming apparatus capable of improving operability during insertion and withdrawal of a pullout unit, and confirming locking failure of the pullout unit with a simple configuration.

According to an aspect of the present invention, an image forming apparatus that forms images on paper sheets with an image forming unit, the image forming unit includes a cover configured to be openable/closable on an apparatus main body, a pullout unit configured to be able to be pulled out with respect to the apparatus main body, a locking member configured to lock the pullout unit according to an operation of inserting the pullout unit into the apparatus main body, an abutting member movable between a position where the abutting member regulates the closure of the cover by abutting against the cover and a position where the abutting member does not regulate the closure of the cover, wherein when the locking member does not lock the pullout unit, the abutting member is positioned at the position where the abutting member regulates the closure of the cover.

According to the present invention, an image forming apparatus capable of allowing an operator to confirm locking failure state with a simple configuration can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, materials, and shapes, and arrangement thereof described in the exemplary embodiments below can be changed as appropriate according to configurations and various conditions of the apparatuses to which the present invention is applied, and it is not intended to limit scope of the present invention to these.

Figure 1:
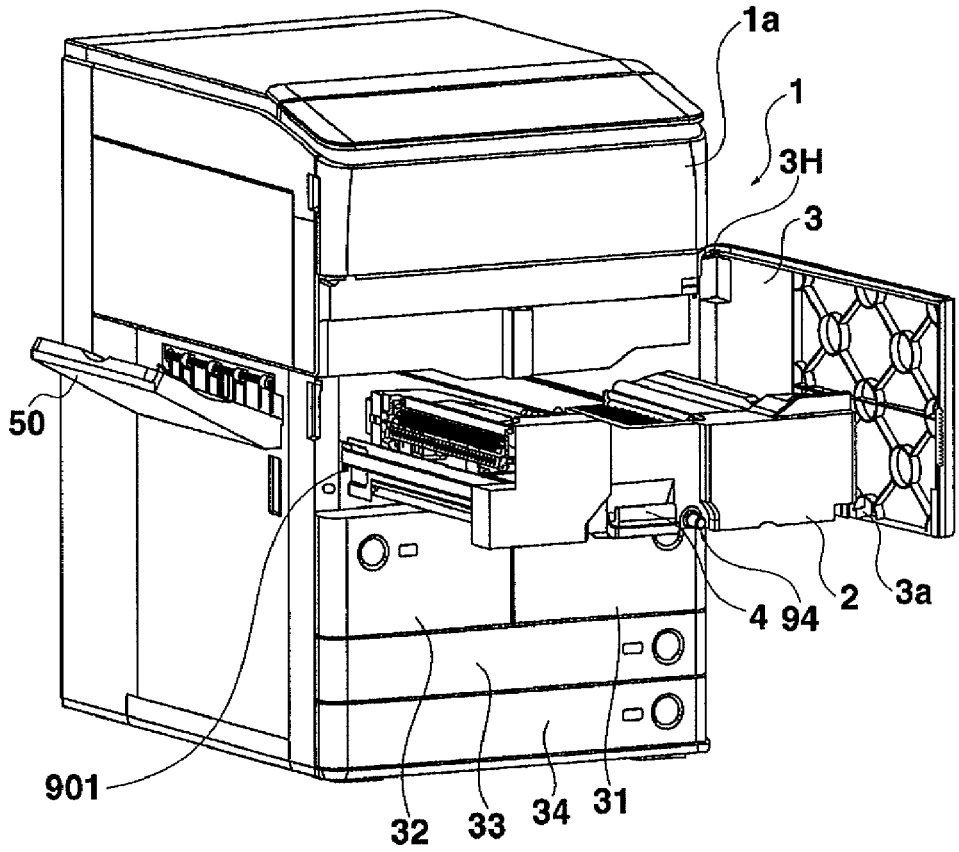
FIG. 1 is a perspective view of an image forming apparatus according to an exemplary embodiment of the present invention.
Figure 2:
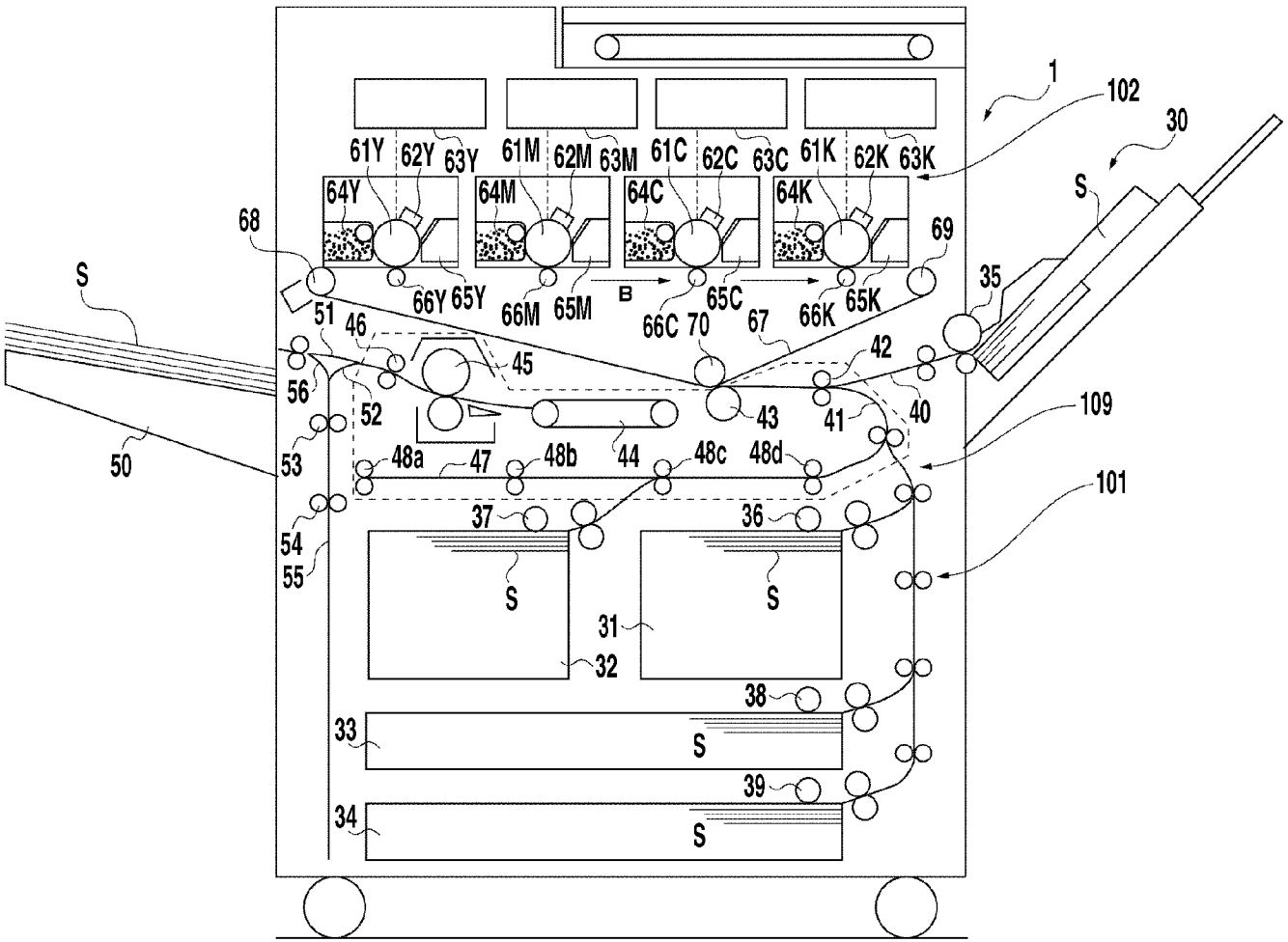
FIG. 2 is a schematic sectional view of the image forming apparatus according to the exemplary embodiment of the present invention.

FIG. 1 is a perspective view of an image forming apparatus as an example according to the exemplary embodiment of the present invention. FIG. 2 is a schematic sectional view of the image forming apparatus as an example according to the exemplary embodiment of the present invention. The image forming apparatus is a color image forming apparatus employing an electrophotographic process. The image forming apparatus adopts an intermediate transfer tandem system in which 4 color image forming units are arranged side by side over the intermediate transfer belt from the viewpoint of advantages of excellence in adaptability to various kinds of sheet materials and print productivity.

A configuration of an image forming apparatus 1 will be described with reference to FIG. 2.

The image forming apparatus 1 includes a sheet feeding unit 101 for feeding sheets, a sheet conveyance device 109 for conveying the sheets fed by the sheet feeding unit 101. Moreover, the image forming apparatus further includes an image forming unit 102 for forming images on the sheets conveyed by the sheet conveyance device 109. The sheet feeding unit 101 includes a top stage sheet accommodating units 31 and 32, a middle stage sheet accommodating unit 33, a bottom stage sheet accommodating unit 34, and a manual feed sheet accommodating unit 30, sheet feeding devices 35 through 39 for feeding the sheets from respective sheet accommodating units.

The image forming unit 102 includes photosensitive members 61 (61Y, 61M, 61C, 61K), charging devices 62 (62Y, 62M, 62C, 62K), exposure devices 63 (63Y, 63M, 63C, 63K), and developing devices 64 (64Y, 64M, 64C, 64K). The image forming unit 102 further includes primary transfer devices 66 (66Y, 66M, 66C, 66K), and photosensitive member cleaners 65 (65Y, 65M, 65C, 65K).

The image forming unit 102 includes an intermediate transfer belt 67 on which toner images formed on the photosensitive members 61Y, 61M, 61C, 61K are primarily transferred. A transfer roller 43 as a transfer unit, for transferring a full-color toner image transferred on the intermediate transfer belt 67 in superposed manner on the sheets, is provided in the image forming unit 102. The intermediate transfer belt 67 as an image bearing member is stretched around a drive roller 68, a tension roller 69 and a inner secondary transfer roller 70, and is conveyance-driven in the direction of an arrow B in FIG. 2. The image forming unit 102 further includes a fixing device 45 for fixing the image on the sheet on which the toner image is transferred.

The sheet conveyance device 109 includes a registration roller 42 for feeding out the sheet to the conveyance paths 40 and 41, and a nip position formed between the intermediate transfer belt 67 and the transfer roller 43. The sheet fed by the sheet feeding units 35 through 39 passes through the conveyance paths 40 and 41. Further, the sheet conveyance device 109 includes a pre-fixing conveyance belt 44 for feeding out the sheet, on which the toner image is transferred, to the fixing device 45.

The sheet conveyance device 109 includes a sheet discharge conveyance path 51 on downstream side of conveyance direction of the fixing device 45, a reversing path 52, and a switchback path 55. The sheet, which has passed through the reversing path 52, passes through the switchback path 55. The sheet conveyance device 109 includes an upper reversing roller 53 and a lower reversing roller 54 provided within the switchback path 55. A two-sided conveyance path 47 conveys the sheets of which conveyance direction is reversed in the switchback path 55, and is connected to the conveyance path 41.

The sheets are accommodated in stack in respective sheet accommodating units 30 through 34, and are fed by respective sheet feeding units 35 through 39 in synchronization with an image formation timing. The sheet S fed out by the sheet feeding units 35 through 39 passes through the conveyance path 40 or 41, and conveyed to the registration roller 42.

The registration roller 42 causes a leading edge of the sheet S to align and correct a skew by creating a loop by causing the sheet S conveyed from each of the sheet accommodating units 30 through 34 to hit thereagainst. Further, the registration roller 42 conveys the sheet to the secondary transfer unit (transfer position) at a predetermined timing in synchronization with a timing of the image formation onto the sheet S, that is, the toner image borne on the intermediate transfer belt 67.

After performing the skew correction, the registration roller 42 feeds out the sheet S to the secondary transfer unit at a desired timing. The secondary transfer unit is a toner image transfer nip portion for transferring the toner image onto the sheet S, which is formed by an inner secondary transfer roller 70 and the transfer roller 43 arranged to oppose each other. In the secondary transfer unit, the toner image is transferred onto the sheet S by applying a predetermined pressurizing force and an electrostatic load bias.

An image forming process performed at the same timing as that of a conveyance process of the above-described sheet up to the secondary transfer unit will be described below.

The surface of the photosensitive member 61, which is rotating, is uniformly charged by the charging devices 62. The exposure devices 63 are driven according to a signal of the sent image information, and a latent image is formed on the photosensitive member 61. The electrostatic latent image formed on the photosensitive member 61 undergoes toner development by the developing devices 64, and then visualized on the photosensitive member 61 as a toner image. After that, a predetermined pressurizing force and electrostatic load bias are applied by the primary transfer devices 66, and the toner image is transferred onto the intermediate transfer belt 67.

After that, residual transfer toner slightly remaining on the photosensitive member 61 is recovered by a photosensitive member cleaner 65, to provide for the next image formation again. The image formation described above is performed for each yellow (Y), magenta (M), cyan (C), and black (K). The toner images of respective Y, M, C, and K colors formed on the photosensitive member 61 are primarily transferred onto the intermediate transfer belt 67, and a full-color toner image is formed on the intermediate transfer belt 67.

In the secondary transfer unit, the full-color toner image is secondarily transferred onto the sheet. After that, the sheet S is conveyed by the pre-fixing conveyance belt 44 to the fixing device 45. The fixing device 45 causes the toner image to be fused and solidified on the sheet S by a predetermined pressurizing force by an opposed roller or belt or the like, and typically heat from heat source such as a heater.

Route selection is performed so that the sheet having thus obtained the fixed image is to be conveyed to either the sheet discharge conveyance path 51 via the inner sheet discharge roller 46, or the reversing path 52, when the reverse sheet discharge or the two-sided image formation is performed. The sheet conveyed within the sheet discharge conveyance path 51 by the inner sheet discharge roller 46 is discharged to the sheet discharge tray 50.

When image formation is performed on both-sides of the sheet, the sheet S is fed from the reversing path 52, by way of the upper reversing roller 53 and the lower reversing roller 54, and is pulled into the switchback path 55. In the switchback path 55, leading and trailing edges of the sheet are switchbacked by reversing the direction of rotation (switchback operation) of the lower reversing roller 54 from previous direction, and is conveyed to the two-sided conveyance path 47.

After that, the sheet merges into the conveyance path 41 in synchronization with a timing with a succeeding sheet being conveyed from respective sheet feeding units 35 through 39, by the two-sided rollers 48*a* through 48*d*, and is fed out to the secondary transfer unit via the registration roller 42. An image formation process on a back face (second face) is similar to the case with a front face (first face) described above, and descriptions thereof will be omitted.

When the sheet is reverse-discharged, the sheet is pulled in from the reversing path 52 to the switchback path 55, and subsequently the sheet is caused to exit by reverse rotation of an upper reversing roller 53 and a lower reversing roller 54, in a direction opposite to a feed-out direction, and is discharged to the sheet discharge tray 50 via the reverse sheet discharging path 56.

As illustrated in FIG. 1, on an image forming apparatus main body 1*a* (hereinafter, referred to as apparatus main body), a front cover 3 is openably/closably attached via a hinge portion 3H. Besides, the pullout unit 2 arranged at an inner side of the closed front cover 3 is supported by a rail 901 serving as a slide supporting mechanism so that the pullout unit 2 is slidably movable to the front of the apparatus relative to the apparatus main body 1*a*, thereby allowing the pullout unit 2 to be pulled out. "Front of apparatus" refers to a side where an operator stands when operating the image forming apparatus, and operation for pulling out the sheet accommodating units 31, 32, 33, and 34 is also performed from the front of the apparatus.

The pullout unit 2 is a unit that integrally supports sheet conveyance unit (range indicated by dashed lines in FIG. 2) including the registration roller 42, the transfer roller 43, the pre-fixing conveyance belt 44, the fixing device 45, the inner sheet discharging roller 46, the two-sided conveyance path 47, and the two-sided rollers 48*a* through 48*d*.

With this configuration, when handling a jam, which occurs on the sheet conveyance path within the pullout unit 2, a jam handling operation can be performed with high visibility and accessibility.

The pullout unit 2 can be pulled out to the front side of the apparatus, by an operation for pulling a handle 4 of a locking unit 94 toward the front, after opening the front cover 3. The detailed configuration of the locking unit 94 will be described below.

With this configuration, since an operation direction of the handle 4 and a pullout direction of the pullout unit 2 substantially coincide with each other, unlocking and pulling out operations can be performed with manipulations easy to intuitively understand. Then, jam handling can be performed with high operability with fewer steps than that by conventional configuration in which the handle 4 is pulled toward the front after the front cover 3 is opened.

Figure 3:
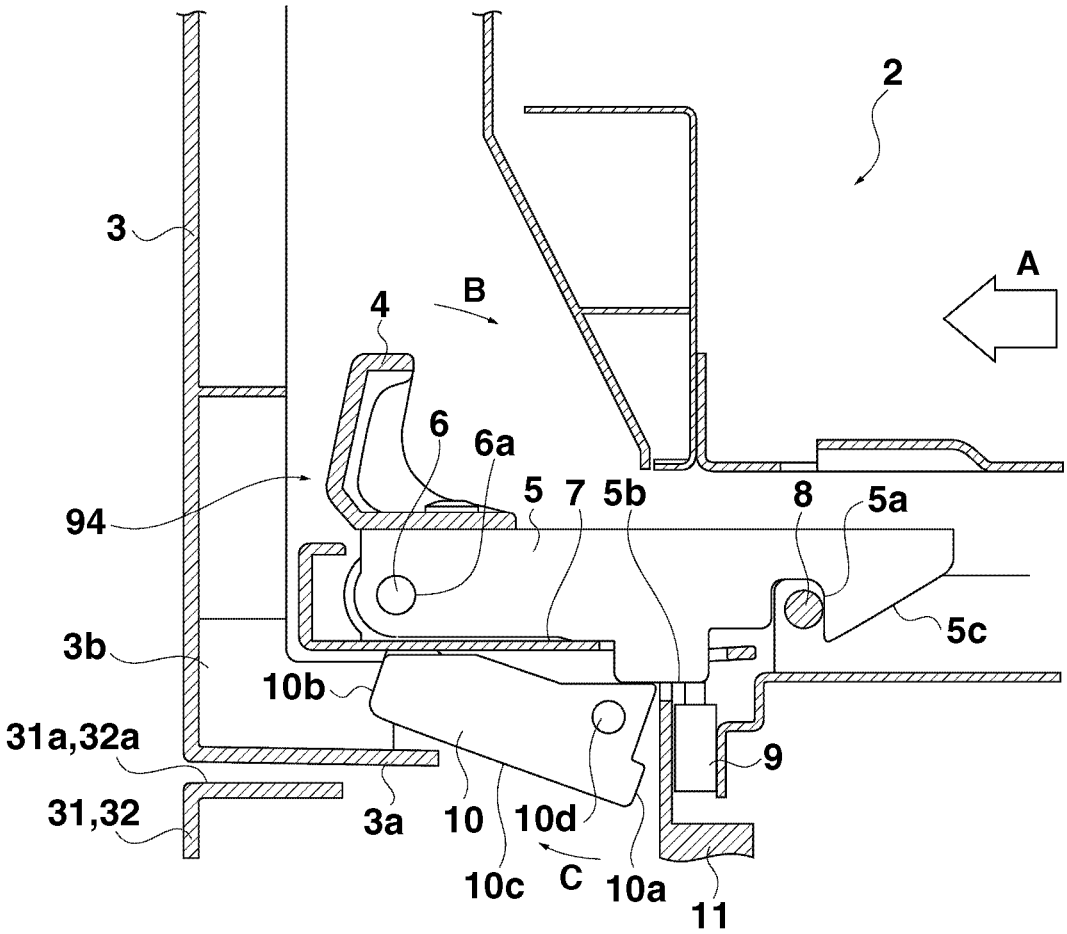
FIG. 3 is a partial sectional view illustrating a locking unit in the image forming apparatus according to the exemplary embodiment of the present invention.
Figure 4:
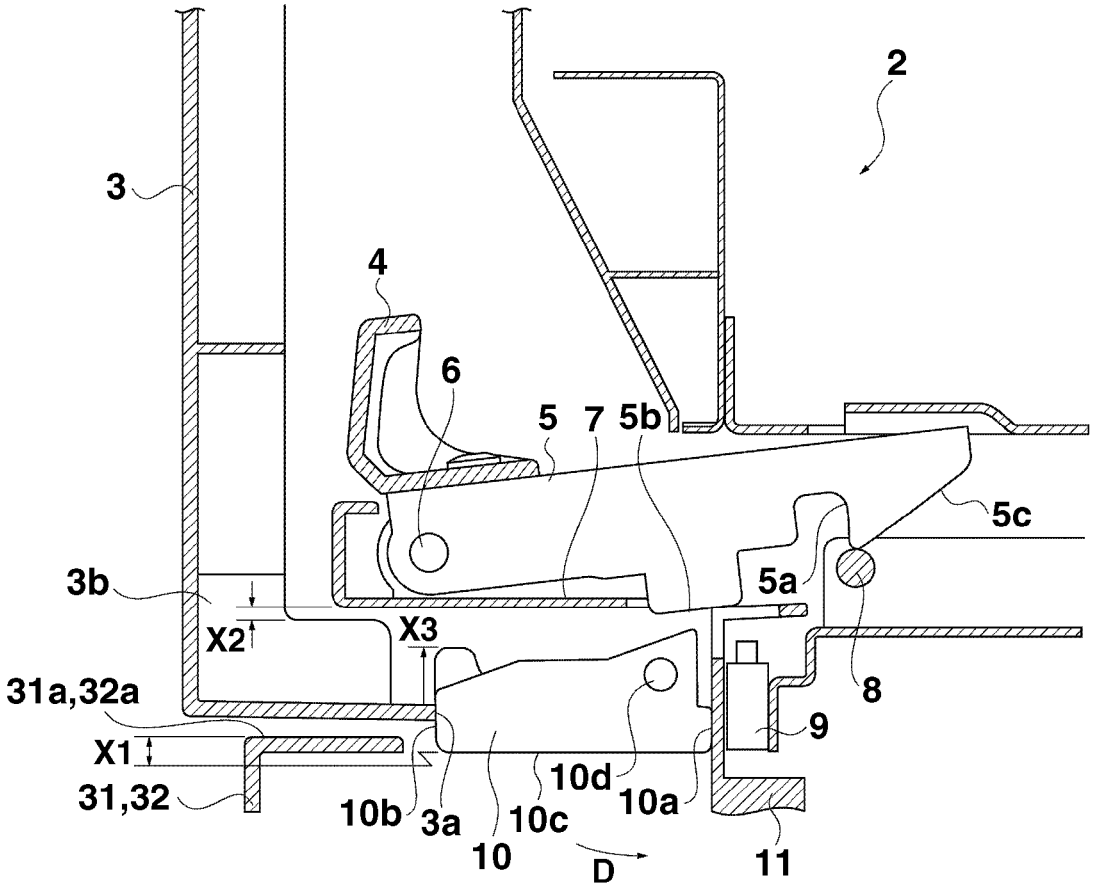
FIG. 4 is a partial sectional view illustrating the locking unit in the image forming apparatus according to the exemplary embodiment of the present invention.

FIGS. 3 and 4 are partial sectional views illustrating configuration of the locking unit 94. Hereinbelow, configuration of the locking unit 94 will be described in detail with reference to FIG. 3 and FIG. 4.

FIG. 3 illustrates a case where the front cover 3 is closed, while the pullout unit 2 is properly mounted.

The pullout unit 2 is urged in "A" direction illustrated in FIG. 3 by an urging unit (not illustrated). On the pullout unit 2, a hook 5 serving as a locking member is swingably supported about a hook shaft 6. In other words, the hook 5 is movably held to the pullout unit 2 by the hook shaft 6 as an example of a first holding unit.

The hook 5 is urged in "B" direction illustrated in FIG. 3 by a torsional coil spring 6*a* as the urging unit, and is held at a position where the hook 5 abuts against a handle base 7. On the tip of the hook 5, there is formed a groove portion 5*a* serving as an engagement groove that engages with a lock shaft 8 disposed in the apparatus main body 1. An inclined plane 5*c* is formed at the tip side of the hook 5.

A handle 4, which an operator operates, is attached to the hook 5. The hook 5 and the lock shaft 8 serving as a receiving member engaged with each other against an urging force in a direction of the arrow "A" to the pullout unit. Thus the pullout unit 2 is fixedly held (locked) at a predetermined position. In the hook 5, there is formed a protruding portion 5*b* for pressing a switch 9 and a link lever 10 disposed in the apparatus main body 1*a*.

The switch 9 serving as a switching unit, upon receiving a pressing force of the protruding portion 5*b*, is turned on, and determines that the pullout unit 2 is in mounting state, and enables power supply to each of the sheet conveyance units within the pullout unit 2.

Besides, the link lever 10 is arranged turnably (movably) about the lever shaft 10*d* in the apparatus main body 1*a*. In other words, the link lever 10 is held turnably (movably) in the apparatus main body 1*a* by a lever shaft 10*d* as an example of a second holding unit. The link lever 10, when abutting against the protruding portion 5*b* of the hook 5 to receive a press from protruding portion 5*b* of the hook 5, rotates in "C" direction illustrated in FIG. 3 against its self-weight, and is located at a position retracted from the edge portion 3*a* of the front cover 3, thereby enabling an operation for closing the front cover 3.

As illustrated in FIG. 3, a position of the link lever 10 at which a leading edge 10*b* of the link lever 10 does not regulate a closing motion of the front cover 3 is a first position of the link lever 10. The link lever 10 constitutes an abutting member according to the present invention for abutting against the front cover 3, which is interlocked with the hook 5, and regulate closure of the front cover 3.

An engagement surface of the hook 5 (front end surface in the protruding portion 5*b*) with the switch 9, and an engagement surface of the hook 5 (front end surface in the protruding portion 5*b*) with the link lever 10 form substantially identical surface.

In the present exemplary embodiment, engagement between the groove portion 5*a* of the hook 5 and the lock shaft 8 is released by moving a handle 4 as an operating handle portion in an opposite direction to the arrow B illustrated in FIG. 3, and turning the handle 4 by 7° in conjunction with the hook 5. Then, the operator further moves the handle 4 in an opposite direction to the arrow B, namely, in a direction to pull out the pullout unit 2 from the apparatus main body 1*a*. Thereby, the pullout unit 2 can be pulled out from the apparatus main body 1*a*. In this way, the handle 4 functions as an operation unit for pulling out the pullout unit 2, and also functions as an operation unit for unlocking the pullout unit 2.

With this configuration, it is possible to provide the image forming apparatus 1 capable of performing unlocking operation of the pullout unit 2 and pullout operation of the pullout unit 2 with high operability, in less operation space, without inviting an increase in size of the apparatus. Moreover, as described above, the direction of the arrow B for moving the handle 4 and the direction of pulling out the pullout unit 2 are the same, resulting in high operability. In other words, to the operator, by only performing operation like pulling out the pullout unit 2 on the handle 4, unlocking by the hook 5 is also performed, thus becoming possible to pull out the pullout unit 2.

On the other hand, when the pullout unit 2 is remounted, the pullout unit 2 is automatically locked by performing operation of pushing in the pullout unit 2. In other words, by an operation of inserting the pullout unit 2 into the apparatus main body 1*a*, an inclined plane 5*c* formed in the leading edge side of the hook 5 and the lock shaft 8 initially abut against each other, and then the hook 5 turns in the opposite direction to the arrow B against the urging force of the urging unit (not illustrated) by a reaction force received from the lock shaft 8.

When the inclined plane 5*c* of the hook 5 surmounts the lock shaft 8 by subsequent further inserting motion of the pullout unit 2, the hook 5 rotates in the arrow B direction by the urging unit (not illustrated), and the groove portion 5*a* of the hook 5 engages with the lock shaft 8, thus establishing mounting state (locking state) illustrated in FIG. 3.

With this configuration, it is possible to provide the image forming apparatus 1 capable of performing recovery operation after jam handling with high operability, through less steps of closing the front cover 5 after having pushed in the pullout unit 2.

FIG. 4 illustrates a state in which operation of closing the front cover 3 has been performed, while mounting motion of the pullout unit 2 (pushing-in motion of the pullout unit 2) is inadequate due to erroneous operation by the operator.

That is, the inclined plane 5*c* of the hook 5 and the locking shaft 8 initially abut against each other, and then the hook 5 moves in the process of motion of inserting the pullout unit 2 into the apparatus main body 1*a*. Then, the operator misidentifies that the pullout unit 2 has been mounted before the inclined plane 5*c* of the hook 5 surmounts the lock shaft 8, and then closes the front cover 3.

When mounting of the pullout unit 2 is thus incomplete, the inclined plane 5*c* of the hook 5 and the lock shaft 8 are in contact with each other, and the hook 5 climbs on the lock shaft 8, as illustrated in FIG. 4. When the hook 5 is positioned at such a position, the protruding portion 5*b* of the hook 5 is spaced apart from the switch 9.

Accordingly, the switch 9 is turned off, and upon determining that the pullout unit 2 is in the dismounted state, causes power supply to the respective sheet conveyance units within the pullout unit 2 to remain shutdown. Moreover, since the dismounted state of the pullout unit 2 is detected based on the off state of the switch 9, an attempt is performed to cause the operator to recognize right operation, while a message for prompting the mounting of the pullout unit 2 is being displayed on the operation unit (not illustrated).

In a state illustrated in FIG. 4, the protruding portion 5*b* of the hook 5, and the link lever 10 are spaced apart from each other. Therefore, the link lever 10 receives urging in a direction of rotation in "D" direction illustrated in FIG. 4 by its self-weight, and is positioned at the second position where the stopper portion 10*a* of the link lever 10 abuts against a switch holder 11.

When the operator tries to close the front cover 3 in this state, the edge portion 3*a* of the front cover 3 abuts against the leading edge 10*b* of the link lever 10, and the link lever 10 regulates closing motion of the front cover 3. Although a configuration in which movement of the link lever 10 to the second position is performed by the self-weight of the link lever 10 is exemplified, the link lever 10 may be caused to move to the second position by, for example, an urging force of a spring.

At this time, since the link lever 10 is sandwiched between the front cover 3 and the switch holder 11 and receives only compression force in a horizontal direction illustrated in FIG. 4, the link lever 10 is configured so that component deformation is not likely to occur. On the other hand, also in the front cover 3, since force is received at the edge portion 3*a* with relatively high strength, the front cover 3 is configured so that component deformation of the front cover 3 is not likely to occur.

With the above-described configuration, when the mounting of the pullout unit 2 (locking by the hook 5) is incomplete, it has become possible to surely regulate the operation of closing the front cover 3 by the edge portion 3*a* of the front cover 3 abutting against the leading edge 10*b* of the link lever 10. Therefore, the operator can recognize that the mounting of the pullout unit 2 is incomplete from the fact that the front cover 3 cannot be closed.

Since it is possible to keep a state in which power supply to the sheet conveyance units of the pullout unit 2, which interlocks with motion of closing the front cover 3, and the apparatus main body 1*a* remains being shut down, malfunction of the image forming apparatus due to erroneous operation by the operator can be surely prevented.

As illustrated in FIG. 4, the underside 10*c* of the link lever 10 is configured to overlap by an intrusion amount of X1 relative to the cover top surfaces 31*a*, 32*a* of the sheet accommodating units 31 and 32 disposed adjacent to the bottom of the front cover 3. In other words, the link lever 10 is arranged over the front cover 3 and the cover of the sheet accommodating units 31 and 32 as another cover.

If the operator closes the front cover 3 while pushing it downward, the underside of the edge portion 3*a* of the front cover 3 is regulated by the cover top surfaces 31*a* and 32*a* of the sheet accommodating units 31 and 32, so that the underside of the edge portion 3*a* of the front cover 3 will not be further lowered.

By the above-described configuration, the underside of the edge portion 3*a* of the front cover 3 and the leading edge 10*b* of the link lever 10 can secure an overlap amount of at least an intrusion amount of equal to or greater than X1. Therefore, even when the operator closes the front cover 3 by inadvertently pushing it downward, the operation for closing the front cover 3 can be surely regulated.

As illustrated in FIG. 4, a rib 3*b* having an air gap amount of X2 is disposed relative to an underside of a handle base 7 as the underside of the pullout unit 2, near the edge portion 3*a* of the front cover 3. Therefore, if the operator closes the front cover 3 by pushing it upward, the rib 3*b* is regulated by the underside of the handle base 7 so that the rib 3*b* will not be raised by a height corresponding to the air gap amount of equal to or greater than X2. In other words, movement to an upward direction of the front cover 3 is regulated within a movable range by the underside of the handle base 7.

At this time, an overlap amount of X3 between the top surface of the leading edge 10*b* of the link lever 10 and the underside of the edge portion 3*a* of the front cover is configured to take much greater value than that of the air gap amount of X2 described above (X3>X2). With the above-described configuration, the underside of the edge portion 3*a* of the front cover 3 and the leading edge 10*b* of the link lever 10 can secure the overlap amount of at least equal to or greater than (X3−X2).

Consequently, even if the front cover 3 is positioned at any position within the above-described movable range, the leading edge 10*b* of the link lever 10 and the front cover 3 come into contact with each other, so that closing motion of the front cover 3 is regulated by the link lever 10. Consequently, even when the operator closes the front cover 3 by inadvertently pushing it upward, an operation for closing the front cover 3 can be surely regulated.

Regarding rotation of the link lever 10, which is interlocked with the hook 5, as illustrated in FIGS. 3 and 4, a displacement amount at the leading edge 10*b* of the link lever 10, at which the front cover 3 abuts thereagainst, is greater than a displacement amount at a location, at which the protruding portion 5*b* of the hook 5 abuts thereagainst. A position of a rotation center of the lever shaft 10*d* of the link lever 10 is thus set. In other words, the link lever 10 is rotated so that the leading edge 10*b* moves in an amplified manner with respect to movement of the protruding portion 5*b* of the hook 5.

Accordingly, abutting of the edge portion 3*b* of the front cover 3 against and retracting from the leading edge 10*b* of the link lever 10 can be surely performed, even though the turning of the hook 5 is very small.

Figure 5:
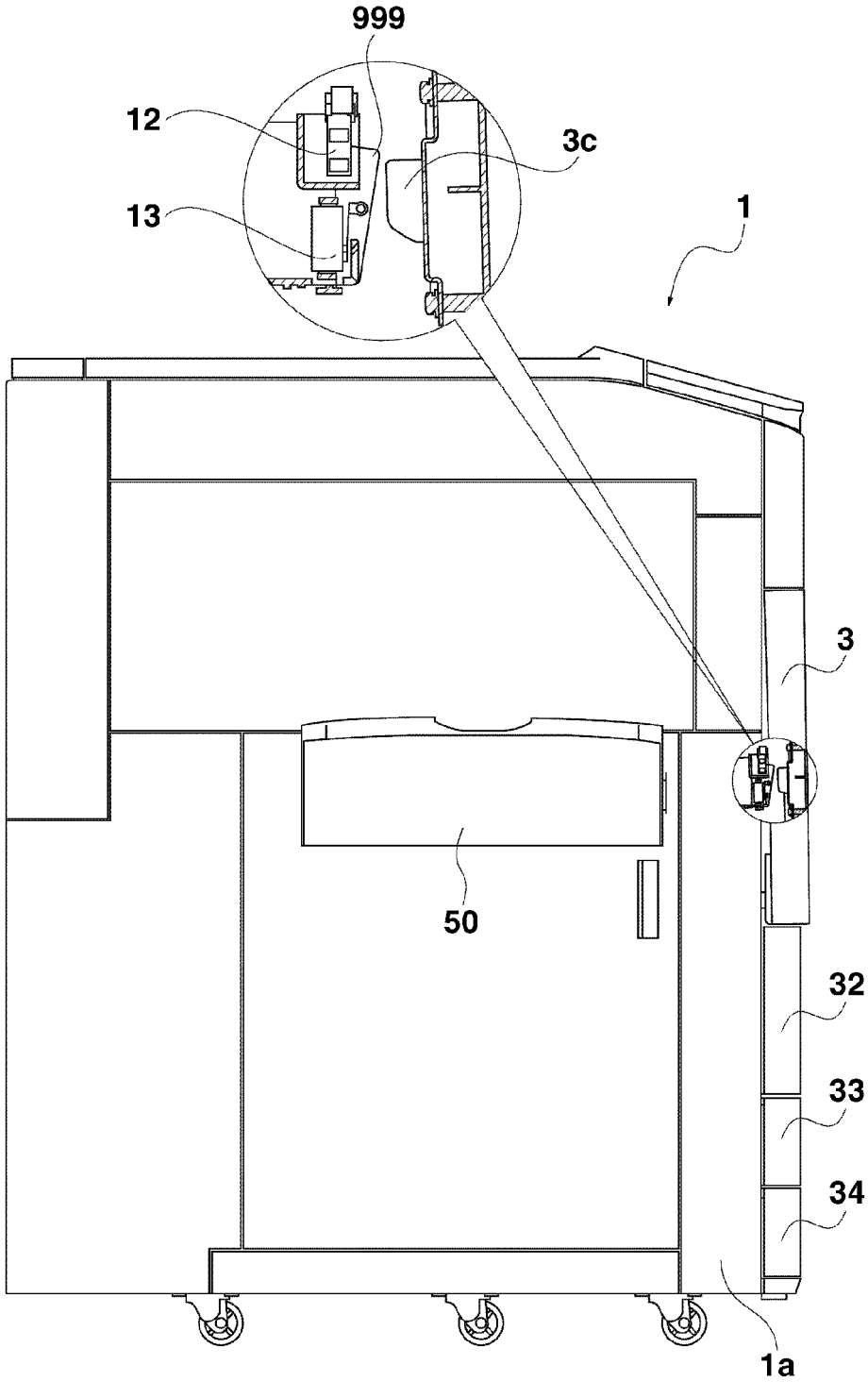
FIG. 5 is a side view with a partial sectional view of the image forming apparatus according to the exemplary embodiment of the present invention.

Subsequently, open/close detection of the front cover 3 will be described below. FIG. 5 is a side view and partial sectional view of the image forming apparatus according to the present exemplary embodiment.

FIG. 5 illustrates a state in which the operator has performed an operation for closing the front cover 3 while mounting of the pullout unit 2 is still incomplete as described in FIG. 4, and the operator further pushes in an upper part of the front cover 3 in a direction of closing the front cover 3.

As described above, the edge portion 3*a* abuts against the link lever 10 so that the lower part of the front cover 3 cannot be pushed in up to a closed position, but due to torsional deformation of the front cover 3, the upper part of the front cover 3 can be pushed in up to a position close to the apparatus main body 1*a* and the front cover 3 may hit thereagainst.

Accordingly, an opposite side to a hinge portion 3H (See FIG. 1) of the front cover 3 may be inclined, as illustrated in FIG. 5.

A lever 3*c* in FIG. 5 is provided at the opposite side to the hinge portion 3H (See FIG. 1) of the front cover 3. Then, the lever 3*c* is attached to the apparatus main body 1*a*, and is configured to come into contact with a leaf spring member 999, which can perform an elastic deformation by being pushed by the lever 3*c*, while the front cover 3 is closed.

An open/close sensor 12 is attached to the apparatus main body 1*a* as a photo interrupter, and detects an open/close state of the front cover 3. When the front cover 3 is closed, and the lever 3*c* presses the leaf spring member 999, on/off state of the open/close sensor 12 serving as an open/close detection sensor is changed by the leaf spring member 999. As a result, the open/close sensor 12 is designed to detect that the front cover 3 is closed.

In addition, a cover open/close switch 13 provided in the apparatus main body 1*a* is designed to be turned on/off by the leaf spring member 999. The cover open/close switch 13 is a switch for switching between power shutdown and supply to the apparatus main body 1*a*, and when the front cover 3 is closed and the cover open/close switch 13 is turned on, then the power supply is executed. When the cover open/close switch 13 is in off state, while the front cover 3 is opened, power supply is shut down.

As illustrated in FIG. 5, even if a side part of opposite side to the hinge portion 3H of the front cover 3 is inclined due to deformation of the front cover 3, the leaf spring member 999 and the lever 3*c* do not come into contact with each other as long as the link lever 10 regulates closure of the front cover 3. Therefore, the open/close sensor 12 for performing the open/close detection of the front cover 3 does not detect the leaf spring member 999.

Further, the cover open/close switch 13 is kept in off state without being pressed by the leaf spring member 999. Therefore, malfunction of the apparatus due to the operator's erroneous operation can be surely prevented.

In the present exemplary embodiment, as described above, an abutting portion (the edge portion 3*a* of the front cover 3) against the link lever 10 in the front cover 3 is provided in the lower part of the front cover 3. Then, the lever 3*c* is provided in the lower part side than central part in vertical direction in the side part of the opposite side to the hinge portion 3H.

With the arrangement of the lever 3*c* in the vertical direction, when the link lever 10 and the edge portion 3*a* of the front cover 3 are in contact with each other, the open/close sensor 12 does not detect the closure of the front cover 3, even if the front cover 3 is somewhat deformed, and the cover open/close switch 13 is also turned off.

In other words, by providing the lever 3*c* at the lower part side (closer side to the edge portion 3*a* that abuts against the link lever 10) in the side portion of the opposite side to the hinge portion 3H, without increasing the cost and rigidity of the front cover 3, erroneous detections of the open/close sensor 12 and the cover open/close switch 13 are prevented.

The link lever 10 according to the present exemplary embodiment is disposed within a range of a projected area of the pullout unit 2 as viewed from the vertical direction. In other words, the link lever 10 is arranged at a back side so that it does not protrude from a front end edge of the pullout direction of the pullout unit 2 to the pullout direction side. Therefore, there are no such risks that the link lever 10 may protrude from the pullout unit 2 to obstruct the operator's jam handling operation, or may be damaged by receiving an inadvertent external force.

The lever shaft 10*d* of the link lever 10 amplifies displacement amount at the leading edge 10*b*, even though a turning amount of the hook 5 is small, and a displacement amount received from the protruding portion 5*b* is small, and is disposed at a position where abutting and retracting of the front cover 3 against and from the edge portion 3*b* can be surely performed. Therefore, with this configuration, malfunction of the apparatus due to the operator's erroneous operation can be surely prevented.

In the above-described exemplary embodiments, there is exemplified a configuration in which the hook 5 serving as the locking member movably held by the pullout unit 2 engages with the lock shaft 8 attached to the apparatus main body 1*a*. However, a member in hook shape may be provided in the apparatus main body 1*a*, and a member that engages with the member in hook shape may be provided in the pullout unit 2.

Figure 6A:
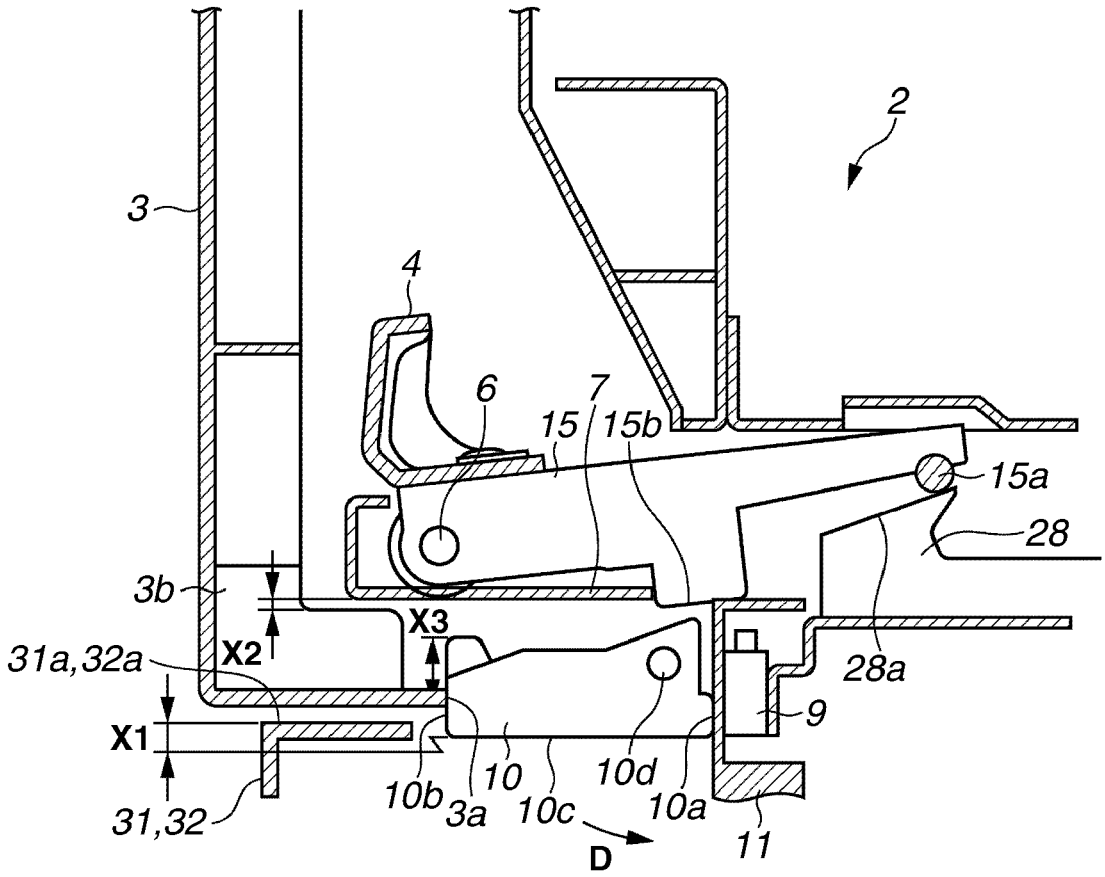
FIG. 6A illustrates a modified example of the present invention.
Figure 6B:
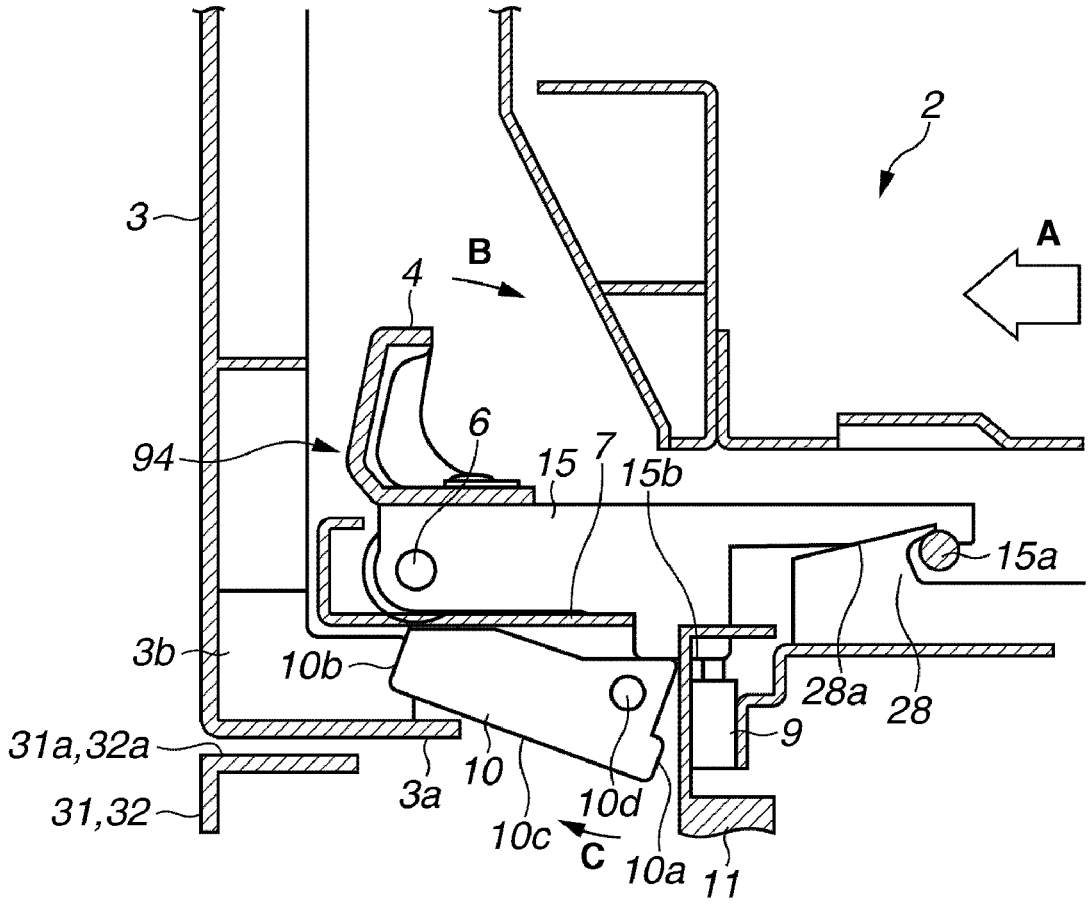
FIG. 6B illustrates a modified example of the present invention.

FIGS. 6A and 6B are sectional views illustrating such a modified example. The same reference numerals are used for the similar members to those in the exemplary embodiment described above. The locking member 15 provided with a pin 15*a* is swingably held by the pullout unit 2. Then, a latch plate 28 having the hook shape is provided in the apparatus main body 1*a*, as a receiving member, with which the locking member 15 engages.

In the middle of insertion operation of the pullout unit 2, as illustrated in FIG. 6A, the locking member 15 performs initial movement by coming into contact with the inclined plane 28*a* of the latch plate 28. At this time, as described above, similarly to the exemplary embodiment, the protruding portion 15*b* of the locking member 15 and the link lever 10 are separated from each other, and the link lever 10 is positioned at a position to regulate closing motion of front cover 3.

As an inserting operation of the pullout unit 2 goes on, after a while, as illustrated in FIG. 6B, the locking member 15 moves to a position where the pin 15*a* of the locking member 15 fits into a groove of the latch plate 28. At this time also, there is a similar action to that in the exemplary embodiment described above. For example, the locking member 15 causes the link lever 10 to move to a position not to regulate closing motion of the front cover 3.

As described above, according to the present exemplary embodiment, the unlocking direction and a sliding direction of the pullout unit substantially coincide with each other. Thus, an operation intuitively easy to understand can be realized. In addition, insertion and pullout operation of the pullout unit 2 can be performed with fewer steps, and, with smaller operation space, and thus high operability can be obtained.

Then, it is possible to allow the operator to easily recognize a locking failure state of the pullout unit 2 by the fact that closure of the front cover is regulated. Moreover, malfunction of the apparatus due to the operator's erroneous operation can be surely prevented with a simple configuration, and the operator can recognize a right operation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155682 filed Jun. 30, 2009, which is hereby incorporated by reference herein in its entirety.

What is claimed is:

1. An image forming apparatus that forms an image on a sheet with an image forming unit, the image forming apparatus comprising:

an apparatus main body;

a cover configured to be openable/closable with respect to the apparatus main body;

a pullout unit configured to be drawable with respect to the apparatus main body;

a locking member configured to lock the pullout unit according to an operation of inserting the pullout unit into the apparatus main body;

a first holding portion movably holding the locking member such that the locking member moves between a locking position where the pullout unit is locked and an unlocking position where the pullout unit is unlocked;

an abutting member configured to abut against the cover so as to regulate the closure of the cover and to interlock with the locking member;

a second holding portion movably holding the abutting member such that the abutting member is moved to a position where the abutting member does not regulate the closure of the cover when the locking member is at the locking position, and is moved to a position where the abutting member regulates the closure of the cover by abutting against the cover when the locking member is at the unlocking position.

2. The image forming apparatus according to claim 1, wherein the first holding portion swingably holds the locking member in the pullout unit, and the apparatus main body is provided with a receiving member that engages with the locking member, wherein the locking member is positioned at the unlocking position where the locking member does not lock the pullout unit by making an abutment against the receiving member with the operation of inserting the pullout unit into the apparatus main body and the locking member moves to the locking position where the pullout unit engages with the receiving member from the unlocking position with the operation of further inserting the pullout unit into the apparatus main body.

3. The image forming apparatus according to claim 1, wherein the abutting member regulates a closing operation of the cover by abutting against an edge portion of the cover.

4. The image forming apparatus according to claim 1, wherein a protruding portion, which comes into contact with the abutting member, is formed in the locking member, and the abutting member comes into contact with the protruding portion of the locking member and is pushed by the locking member, when the locking member is positioned at the locking position where the locking member locks the pullout unit, so that the abutting member is positioned at the position where the abutting member does not regulate the closure of the cover, and wherein the protruding portion moves apart from the abutting member, when the locking member is at the unlocking position where the locking member does not lock the pullout unit, so that the abutting member is positioned at the position where the abutting member regulates the closure of the cover.

5. The image forming apparatus according to claim 1, wherein the abutting member is disposed over the cover and another cover provided in the apparatus main body adjacent to the cover in a closed state.

6. The image forming apparatus according to claim 1, wherein the cover is regulated by an underside of the pullout unit so that upward movement of the cover falls within a movable range, and wherein, even if the cover is at any position within the movable range of the cover, the abutting member is arranged so that a closing motion of the cover is regulated by the abutting member positioned at the position where the abutting member regulates the closure of the cover.

7. The image forming apparatus according to claim 1, wherein the abutting member does not protrude beyond a front edge of the pullout unit in the pullout direction, when the pullout unit is mounted at a predetermined position in the apparatus main body.

8. The image forming apparatus according to claim 1, wherein the abutting member moves interlocking with the locking member by contacting with the locking member, and the abutting member is arranged swingably in the apparatus main body, so that a displacement amount of an abutting position against the cover becomes larger than a displacement amount of an abutting position against the locking member.

9. The image forming apparatus according to claim 1, further comprising:

a switching unit configured to be turned on or off according to positions of the locking member, and to supply or shut down electric power to the pullout unit, wherein an engagement surface where the locking member comes into contact with the abutting member to interlock with the abutting member, and an engagement surface where the locking member comes into contact with the switching unit are substantially identical surfaces.

10. The image forming apparatus according to claim 1, further comprising:

an open/close detection sensor provided in the apparatus main body, configured to detect open/close state of the cover; and a lever provided on the cover and configured to turn the open/close detection sensor on or off, wherein in a state where the abutting member positioned at the second position regulates closure of the cover, the open/close detection sensor and the lever are disposed at a position where on/off of the open/close detection sensor is not changed even if an attempt is made to close the cover from the state in which the cover is opened.

11. The image forming apparatus according to claim 1, wherein the image forming unit includes an image bearing member, and a transfer member configured to transfer a toner image borne by the image bearing member onto a transfer position, wherein the image forming apparatus further includes a registration unit configured to convey a sheet to the transfer position, and a pre-fixing conveyance unit configured to convey the sheets, on which the toner images are transferred, to a fixing device, and wherein the pullout unit includes the registration unit, the transfer member, the pre-fixing conveyance unit, and the fixing device.

12. The image forming apparatus according to claim 1, further comprising:

an operation handle, provided on the locking member, used to pull out the pullout unit, wherein the locking member moves so that locking by the locking member is unlocked by operating the operation handle in pullout direction of the pullout unit.

13. The image forming apparatus according to claim 1, wherein the abutting member interlocks with the locking member such that the abutting member is positioned at the position where the abutting member does not regulate the closure of the cover when the locking member is at the locking position where the locking member locks the pullout unit, and at the position where the abutting member regulates the closure of the cover when the locking member is at the unlocking position where the locking member does not lock the pullout unit.

14. The image forming apparatus according to claim 1, wherein the pullout unit includes a sheet conveyance unit that conveys a sheet on which the image is formed by the image forming unit.

15. The image forming apparatus according to claim 1, wherein the first holding portion is provided on the pullout unit, the second holding portion is provided on the apparatus main body, and the cover is rotatably supported on the apparatus main body.

* * * * *